US007523934B2

(12) United States Patent
Takeda et al.

(10) Patent No.: US 7,523,934 B2
(45) Date of Patent: Apr. 28, 2009

(54) ROLLER STRUCTURE

(75) Inventors: Kazuhisa Takeda, Nagano (JP); Yosuke Nakano, Nagano (JP); Tsuyoshi Sekizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 11/391,202

(22) Filed: Mar. 29, 2006

(65) Prior Publication Data

US 2006/0245777 A1 Nov. 2, 2006

(30) Foreign Application Priority Data

Mar. 29, 2005 (JP) ..... P2005-093817

(51) Int. Cl.
*B65H 29/20* (2006.01)

(52) U.S. Cl. ..... 271/314; 271/198

(58) Field of Classification Search ..... 271/314, 271/198

See application file for complete search history.

(56) References Cited

U.S. PATENT DOCUMENTS 3,945,635 A * 3/1976 Marin ..... 271/202
4,089,378 A * 5/1978 Suzuki ..... 169/54
4,106,767 A * 8/1978 Schirrmeister et al. ..... 271/188
5,181,715 A * 1/1993 Ohkoda et al. ..... 271/272
5,209,466 A * 5/1993 Watts et al. ..... 271/188
5,428,437 A * 6/1995 Carter et al. ..... 399/18
6,070,870 A * 6/2000 Gramlich et al. ..... 271/314
6,241,619 B1 * 6/2001 Russell ..... 464/183
6,464,217 B1 * 10/2002 Kulpa et al. ..... 271/116
6,619,795 B1 * 9/2003 Hiramatsu ..... 347/104
7,066,463 B2 * 6/2006 Zembko et al. ..... 271/272
7,140,607 B2 * 11/2006 Graef et al. ..... 271/122
7,264,239 B2 * 9/2007 Kawai ..... 271/188
2004/0265020 A1 * 12/2004 Aruga ..... 399/329

FOREIGN PATENT DOCUMENTS

JP 2003-335430 A 11/2003

* cited by examiner

*Primary Examiner*—Patrick H Mackey
*Assistant Examiner*—Prasad V Gokhale
(74) *Attorney, Agent, or Firm*—Sughrue Mion, PLLC

(57) ABSTRACT

A first roller member is adapted to be fitted on a roller shaft, and includes at least one first portion, extending in a circumferential direction of the roller shaft, and having a first thickness in a radial direction of the roller shaft, and at least one second portion, extending in the circumferential direction, and having a second thickness in the radial direction which is greater than the first thickness, and at least one projection, formed on the first portion. A second roller member is formed on the first roller member, and includes a third portion, opposing the second portion, and having a third thickness in the radial direction, and a fourth portion, opposing the first portion, and having a fourth thickness in the radial direction which is greater than the third thickness.

10 Claims, 9 Drawing Sheets

ROLLER STRUCTURE

BACKGROUND OF THE INVENTION

The present invention relates to a recording apparatus and to a liquid ejecting apparatus of an ink jet type recording apparatus or the like for ejecting a liquid of ink or the like from a head thereof to eject to a target medium. Further, the invention particularly relates to a roller structure provided in the apparatuses.

Here, a liquid ejecting apparatus includes not only a recording apparatus of a printer, a copier, a facsimile or the like using an ink jet type recording head and ejecting ink from the recording head to record on a recording medium but also an apparatus of ejecting a liquid corresponding to a use thereof in place of ink from a liquid ejecting head corresponding to the recording head to a target medium in correspondence with the recording medium to adhere the liquid to the target medium.

As a liquid ejecting head, other than the recording head, there is pointed out a colorant ejecting head used for fabricating a color filter of a liquid crystal display or the like, an electrode (conductive paste) ejecting head used for forming an electrode of an organic EL display, a face light emitting display (EFD) or the like, a living body organism ejecting head used for fabricating a biochip, a sample ejecting head as a precision pipette or the like.

In a related ink jet printer, as shown by, for example, JP-A-2003-335430, there is adopted a method of fabricating a sheet discharge driving roller by molding a sheet discharge roller shaft with a resin and injecting elastomer thereon to form a roller forming portion, with an object of reducing cost. As shown by FIG. 8 through FIG. 10, a sheet discharge driving roller 100 is formed with 4 pieces of rotation stopping portions 105 in a projecting shape extended in an axial direction of a sheet discharge roller shaft 103 at portions thereof for bringing a roller forming portion 101 and the sheet discharge roller shaft 103 into contact with each other such that a shift of the roller forming portion 101 is prevented in a surrounding area of the sheet discharge roller shaft 103.

However, although at an initial stage of injecting elastomer to a surrounding area of the sheet discharge roller shaft 103, the roller forming portion 101 is formed in a cylindrical shape, when elastomer is shrunk by cooling, as shown by FIG. 9, portions in correspondence with 4 pieces of the rotation stopping portions 105 are constituted by a slightly projecting shape (shown more or less out of proportion in the drawing) since a rate of shrinking a thickness of a thick-walled portion is larger than a rate of shrinking a thickness of a thin-walled portion. Therefore, as shown by FIG. 10, a circularity of a section of the sheet discharge driving roller 100 is deteriorated to decrease an accuracy of feeding a sheet or to cause to skew the sheet.

SUMMARY

It is therefore an object of the invention to provide a roller structure capable of forming a roller forming portion having a completely round section in a surrounding area of a roller shat, and a recording apparatus and a liquid ejecting apparatus having the same.

In order to achieve the object, according to the invention, there is provided a roller structure comprising:

a first roller member, adapted to be fitted on a roller shaft, and comprising:

at least one first portion, extending in a circumferential direction of the roller shaft, and having a first thickness in a radial direction of the roller shaft; and at least one second portion, extending in the circumferential direction, and having a second thickness in the radial direction which is greater than the first thickness; and at least one projection, formed on the first portion; and a second roller member, formed on the first roller member, and comprising:

a third portion, opposing the second portion, and having a third thickness in the radial direction; and a fourth portion, opposing the first portion, and having a fourth thickness in the radial direction which is greater than the third thickness.

With this configuration, when the second roller member is formed in the surrounding area of the first roller member by injection molding, at the third portion, a uniform thickness is constituted since the third portion is uniformly shrunk during cooling over all the surrounding of the section orthogonal to the axial direction of the roller shaft. Therefore, a medium driven by the roller is accurately carried. Further, at the fourth portion formed at the portion which does not require the circle section which is orthogonal to the axial direction and which is completely round to high accuracy, thickness reduction rate during cooling after injection molding at the fourth portion differs from thickness reduction rate at the third portion and therefore, surfaces of the third portion and the fourth portion are not flush with each other. However, the high accuracy of the completely round circle is not required at the fourth portion and therefore, a problem is not posed owing thereto. Further, the projection is formed at the first portion of the first roller member on which the fourth portion is formed and therefore, the second roller member is prevented from being rotated to shift in the circumferential direction in the surrounding area of the first roller member during rolling the roller.

A sum of the first thickness and the fourth thickness may be identical with a sum of the second thickness and the third thickness The second roller member may be comprised of elastomer.

In this case, the thickness reduction rate at the fourth portion becomes larger than the thickness reduction rate at the third portion after injection molding of elastomer and therefore, the invention becomes significant.

The first roller member may include a plurality of the first portions and a plurality of the second portions which are alternately arranged in an axial direction of the roller shaft.

The projection may be formed on one of the first portions located between two of the second portions.

A plurality of the projections may be arrayed in the circumferential direction.

In this case, after curing a roller constituting material, the cured roller constituting material is engaged with the projections at a plurality of positions in the circumferential direction of a groove portion and therefore, rotation of the second roller member is made to be further difficult to be shifted.

A plurality of the projections may be arrayed in the axial direction.

A top face of the projection may be flush with an outer circumferential face of the second portion of the first roller member.

In this case, the medium is carried while being supported between two outer circumferential faces of the two second portions without being deformed into recesses and projections.

In order to achieve the object, according to the invention, there is provided a roller comprising:

a roller shaft; and the roller structure according to claim 1, fitted on the roller shaft.

With this configuration, the roller of the mode is provided with a high accuracy of the completely round circle at portions of rollers on a drive side and a follow side brought into contact with each other and therefore, the media can be realized to be carried accurately.

In order to achieve the object, according to the invention, there is provided an apparatus comprising:

the roller according to claim 9; and a follower roller, opposing the second portion of the first roller member, and adapted to be rotated by the roller.

With this configuration, only the third portion is formed at positions respectively brought into contact with the follower roller and therefore, the accuracy of the completely round circle of the section is high, the third portion continues to be brought into contact with the follower roller always in the same state and therefore, the medium can accurately be carried.

The follower roller may be spur roller.

In this case, although a roller having a small width such as the spur roller is liable to be rotated idly or slipped by an influence of recesses and projections of a surface of a driving roller such as a discharge driving roller, the accuracy of the completely round circle of a portion on a side of the discharge driving roller brought into contact with the spur roller is high and therefore, a state of bringing the spur roller and the discharge driving roller into contact with each other is constantly maintained and a stable discharging operation of the recording medium can be realized.

The roller may be operable to discharge a medium from the apparatus.

In this case, in the apparatus, a stable discharging operation of the medium without skewing, jamming or the like can be realized.

DETAIL DESCRIPTION OF PREFERRED EMBODIMENTS

An embodiment of the invention will be explained in reference to the drawings, FIGS. 1 through 7 as follows.

Figure 1:
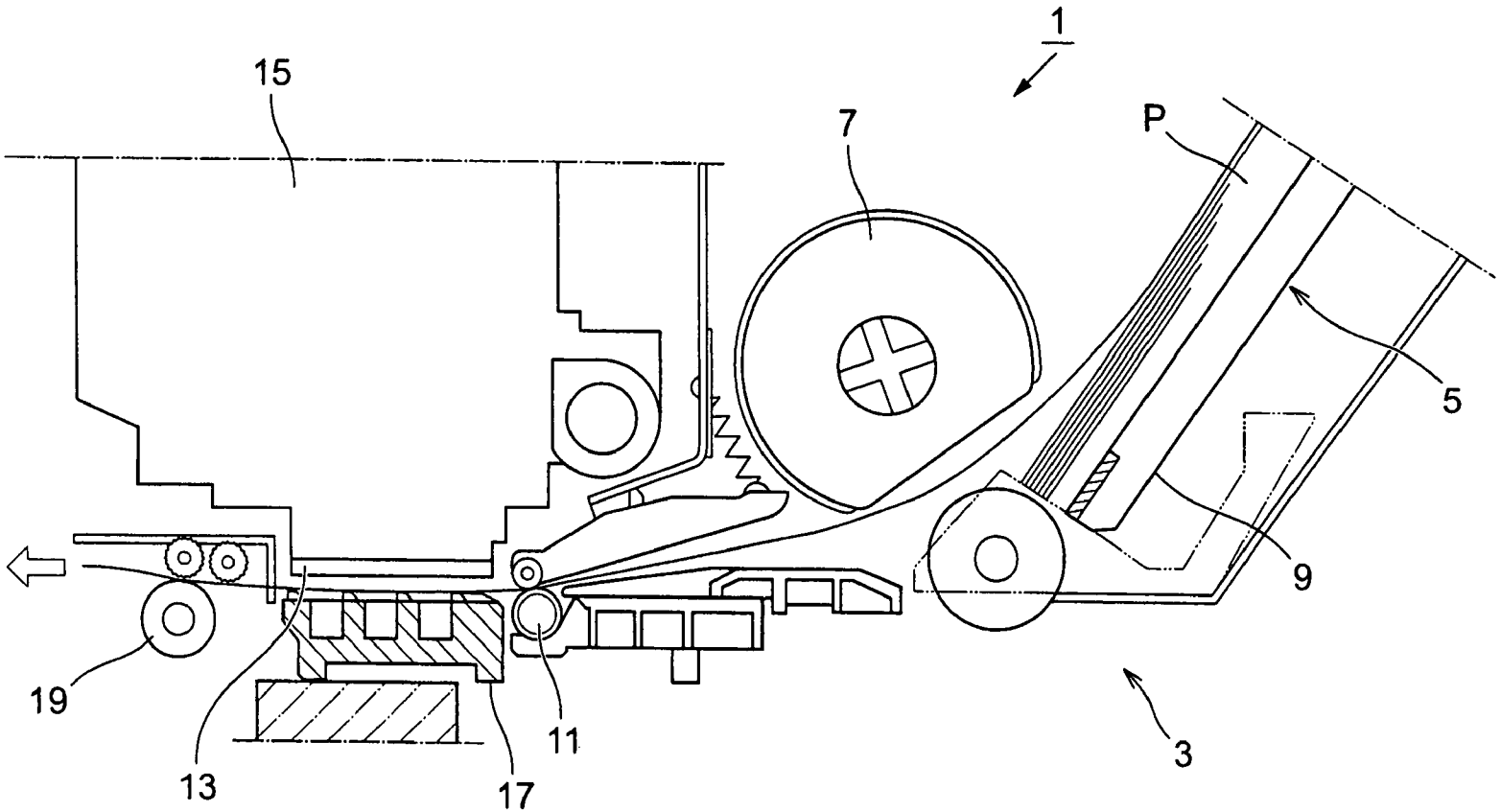
FIG. 1 is a side sectional view of a recording apparatus to which a roller structure according to the invention is applied.
Figure 2:
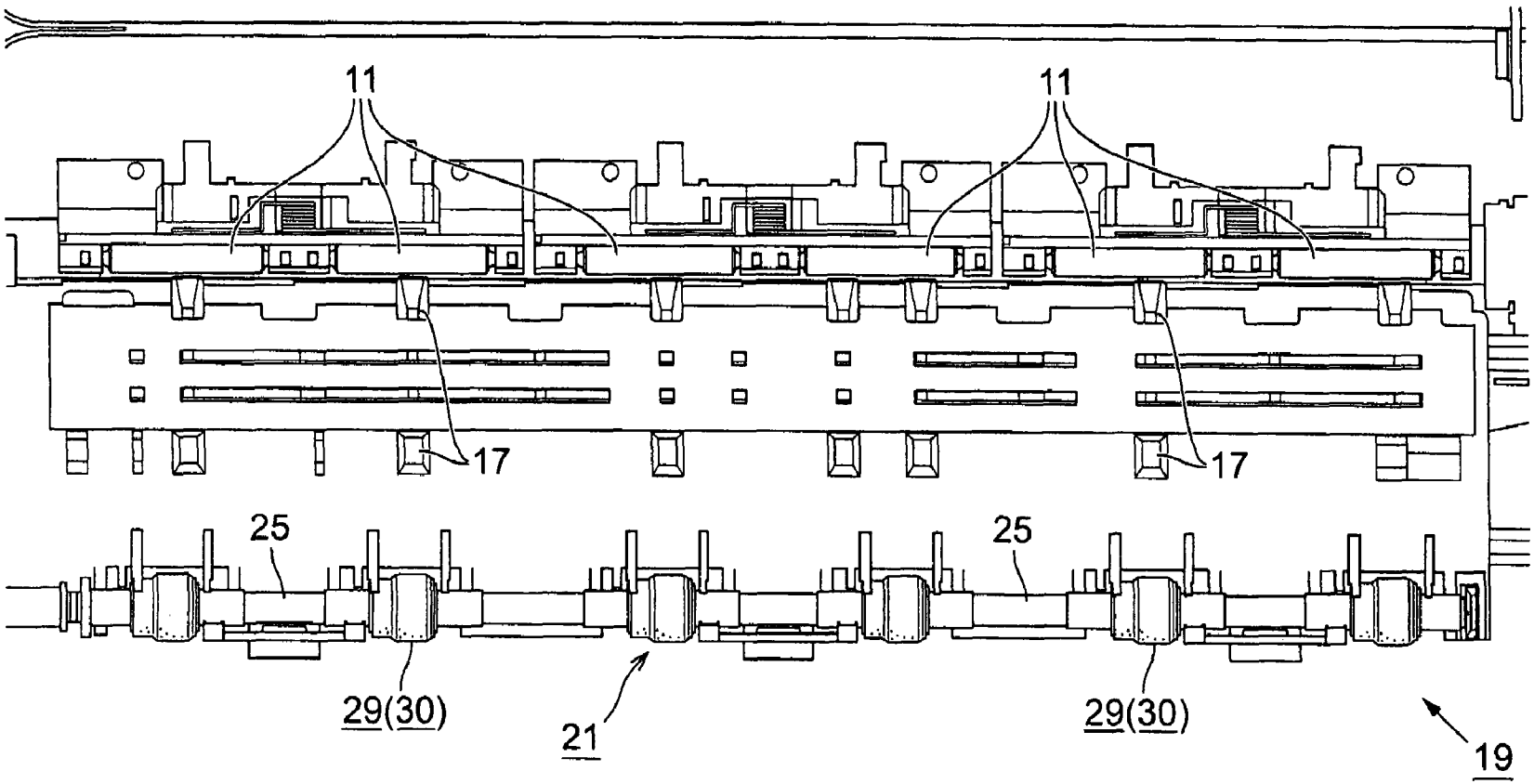
FIG. 2 is a top view of a platen position of the recording apparatus.
Figure 3:
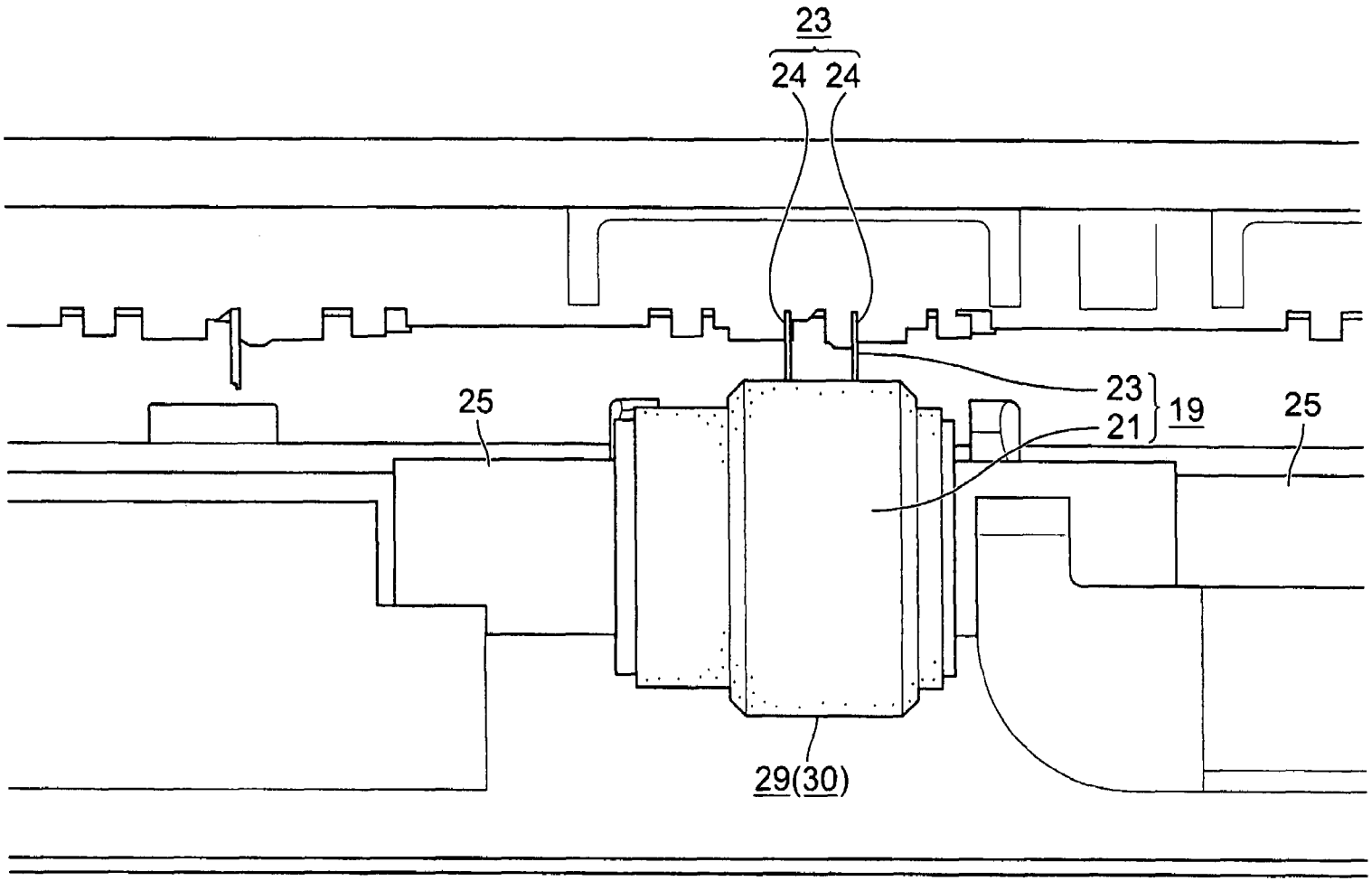
FIG. 3 is a front view showing a discharge roller to which the invention is applied.

A recording apparatus 1 shown in FIG. 1 is an ink jet type recording apparatus and a rear side (right side of FIG. 1) thereof is provided with a cassette 5 attachable and detachable to and from a recording apparatus main body 3 for feeding a recording medium P. The recording medium P before recording is laminated above the feeding cassette 5 and is pressed to an outer peripheral face of a feeding roller 7 by a hopper 9 pivoted to a side of the feeding roller 7 at a predetermined timing in feeding. The recording medium P pressed to the outer peripheral face of the feeding roller 7 is automatically fed sheet by sheet to a carrying roller 11 by driving to rotate the feeding roller 7. Further, the recording medium P is carried in a sub scanning direction (left direction of FIG. 1) by a carrying amount in accordance with an amount of rotating the carrying roller 11.

Further, the recording apparatus 1 is provided with a carriage 15 for scanning a recording head 13 for ejecting ink to the recording medium P to record in a main scanning direction (direction orthogonal to paper face of FIG. 1) relative to the recording medium P. The carriage 15 is attachably and detachably mounted with ink cartridges filled with inks of respective colors and respective colors of inks are supplied from the ink cartridges to the recording head 13. A head face of the recording head 13 is reciprocated in the main scanning direction at a position opposed to a platen 17, and inks are ejected from a number of nozzles arranged at the head face to the recording medium P carried on the platen 17. The recording medium P finished with recording is discharged in the sub scanning direction by a discharge roller 19 (refer to FIG. 2).

A characteristic of the invention will be explained as follows by taking an example of the discharge roller 19. The discharge roller 19 is constituted by a discharge driving roller 21 and a discharge follower roller 23, and the discharge driving roller 21 is constituted by including a roller shaft 25 formed with a resin by injection molding, a roller carrying portion 27 (refer to FIG. 4) integrally formed on the roller shaft 25, and a roller forming portion 29 formed by injecting elastomer to a surrounding area of the roller carrying portion 27 (refer to FIG. 3). Further, the roller carrying portion 27 and the roller forming portion 29 constitute a roller portion 30. On the other hand, the discharge follower roller 23 is mainly constituted by two of spur rollers 24, and two of the spur rollers 24 are arranged to be spaced apart from one another by constant intervals therebetween.

Figure 6:
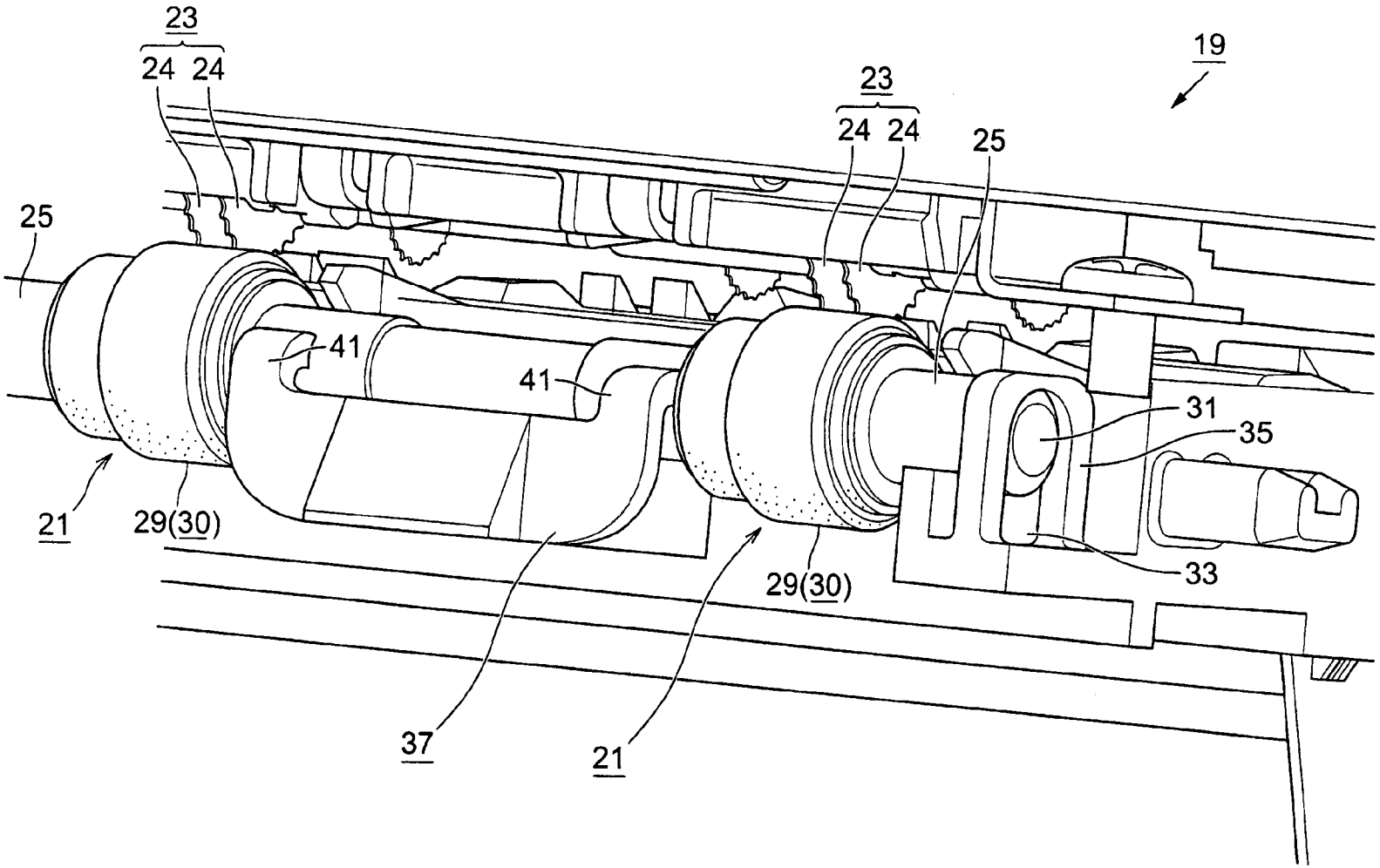
FIG. 6 is a perspective view showing an end portion of the roller shaft and a resin spring.

As shown by FIG. 6, an end portion 31 of the roller shaft 25 is axially supported on a bearing 33 and a surrounding area of the end portion 31 is formed with a shaft end holding member 35 in an inverse U-like shape (horseshoe shape). At normally using time, a small clearance is formed between the end portion 31 of the roller shaft 25 and an uppermost portion of an inner face of the shaft end holding member 35 to prevent friction from being produced between the end portion 31 and the shaft end holding member 35 during rotating the roller shaft 25. The shaft end holding member 35 is provided in this way for preventing the roller shaft 25 from being detached to an upper side when the recording medium P is jammed during being carried and a user is going to forcibly pull out the jammed recording medium P.

Figure 7:
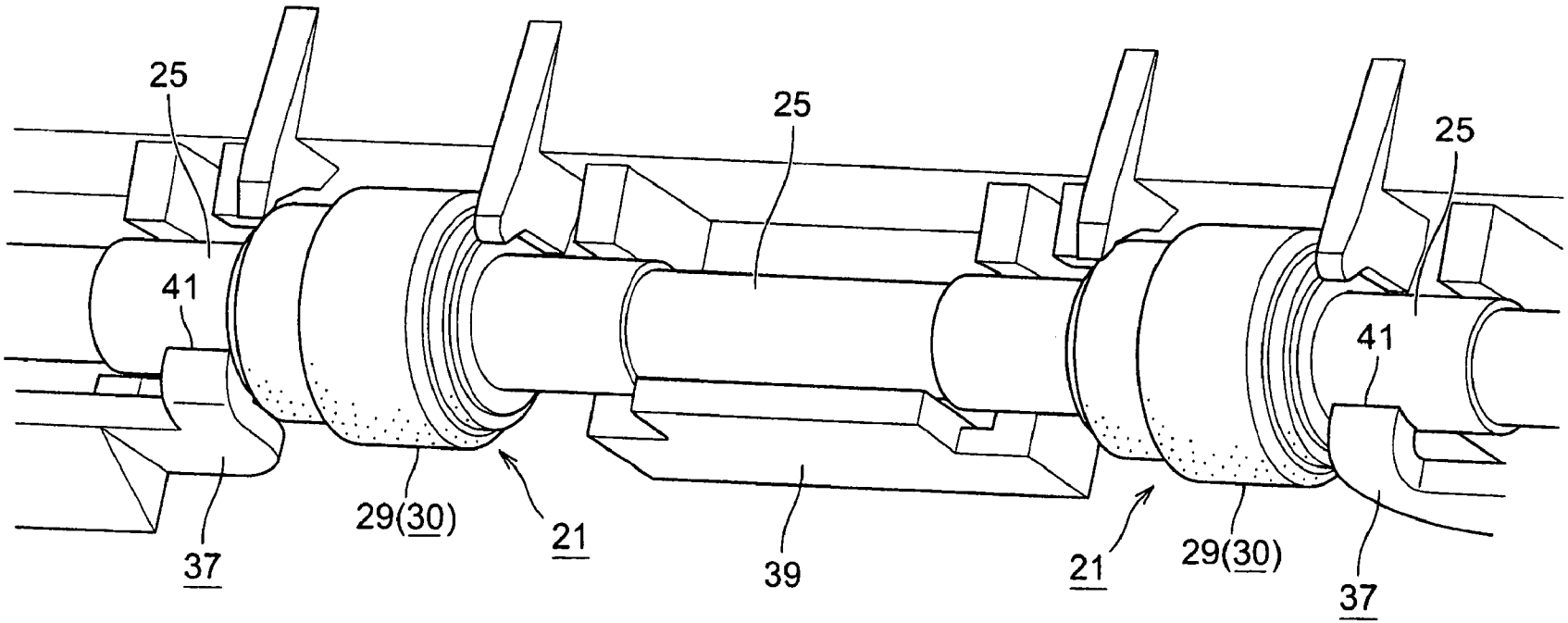
FIG. 7 is a perspective view showing a relationship among the roller shaft, the resin spring and a degree holder.
Figure 8:
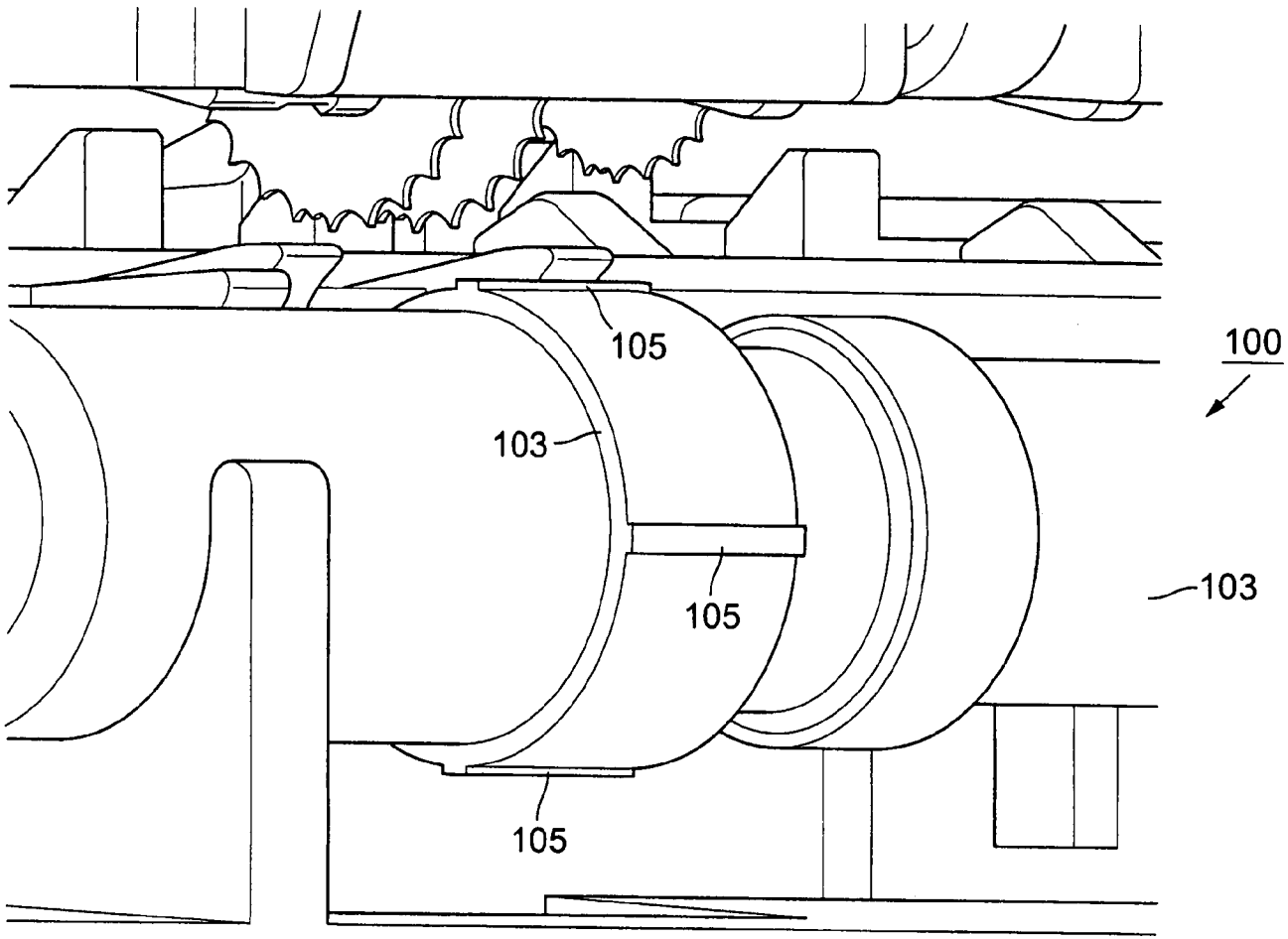
FIG. 8 is a perspective view showing a state of a related roller shaft before forming a roller forming portion.
Figure 9:
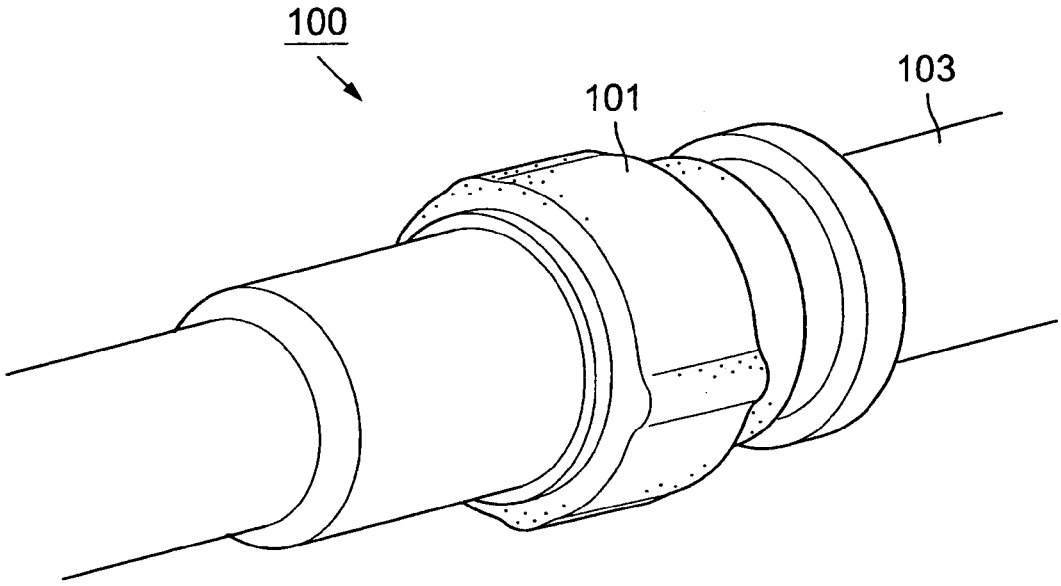
FIG. 9 is a perspective view showing the related roller shaft.
Figure 10:
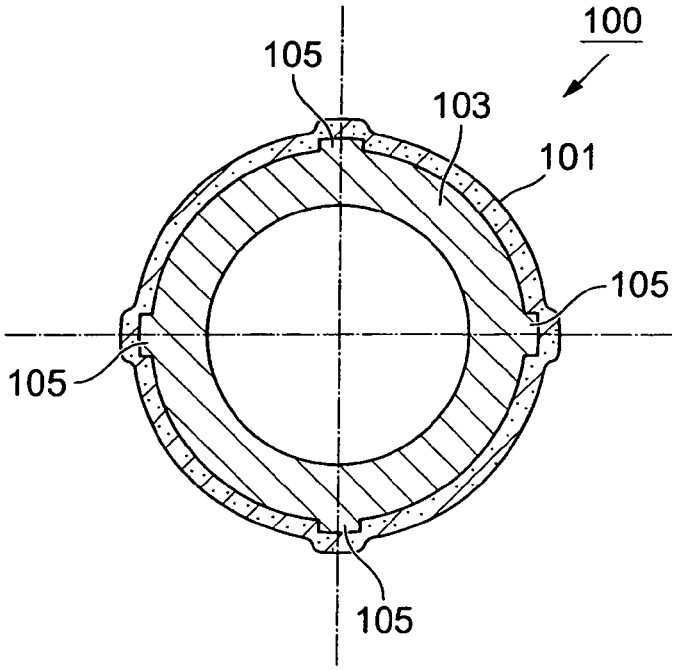
FIG. 10 is a sectional view showing the related roller shaft.

Further, as shown by FIGS. 6 and 7, resin springs 37 and degree holders 39 are alternately provided contiguously to the driving roller shaft 25 among the respective roller portions 30. The resin spring 37 is formed with respective two spring operating portions 41 and the spring operating portions 41 are brought into contact with a surface of the roller shaft 25 to urge the roller shaft 25 to an upstream side. The reason of providing the resin spring 37 is as follows.

Although the roller shaft 25 can be fabricated inexpensively by forming the roller shaft 25 with a resin instead of a metal in a background art, on the other hand, the roller shaft 25 is easy to be bent. Further, in carrying the recording medium P, the recording medium P is prevented from being bent between the two rollers by rotating the discharge roller 19 by a speed slightly faster than that of the carrying roller 11. Thereby, in carrying the recording medium P, the roller shaft 25 is pulled to the upstream side and therefore, when a rear end of the recording medium P is detached from the carrying roller 11, a tension force is nullified instantaneously to bring about a rapid movement of the roller shaft 25 to a downstream side, that is, a so-to-speak "kick out phenomenon". The resin spring 37 can restrain the roller shaft 25 from being moved to the downstream side by the kick out phenomenon. Further, the resin spring 37 is provided also with an object of preventing the roller shaft 25 from being rattled unstably when the user touches the discharge roller 19 by the hand.

Further, the degree holder 39 is normally positioned to be slightly remote from a portion of the surface of the roller shaft 25 which does not require accuracy. By providing the degree holder 39 in this way, the resin spring 37 can be prevented from being broken or detached by significantly bending the roller shaft 25 to the downstream side when the user pulls out the recording medium P to the downstream side.

Figure 4:
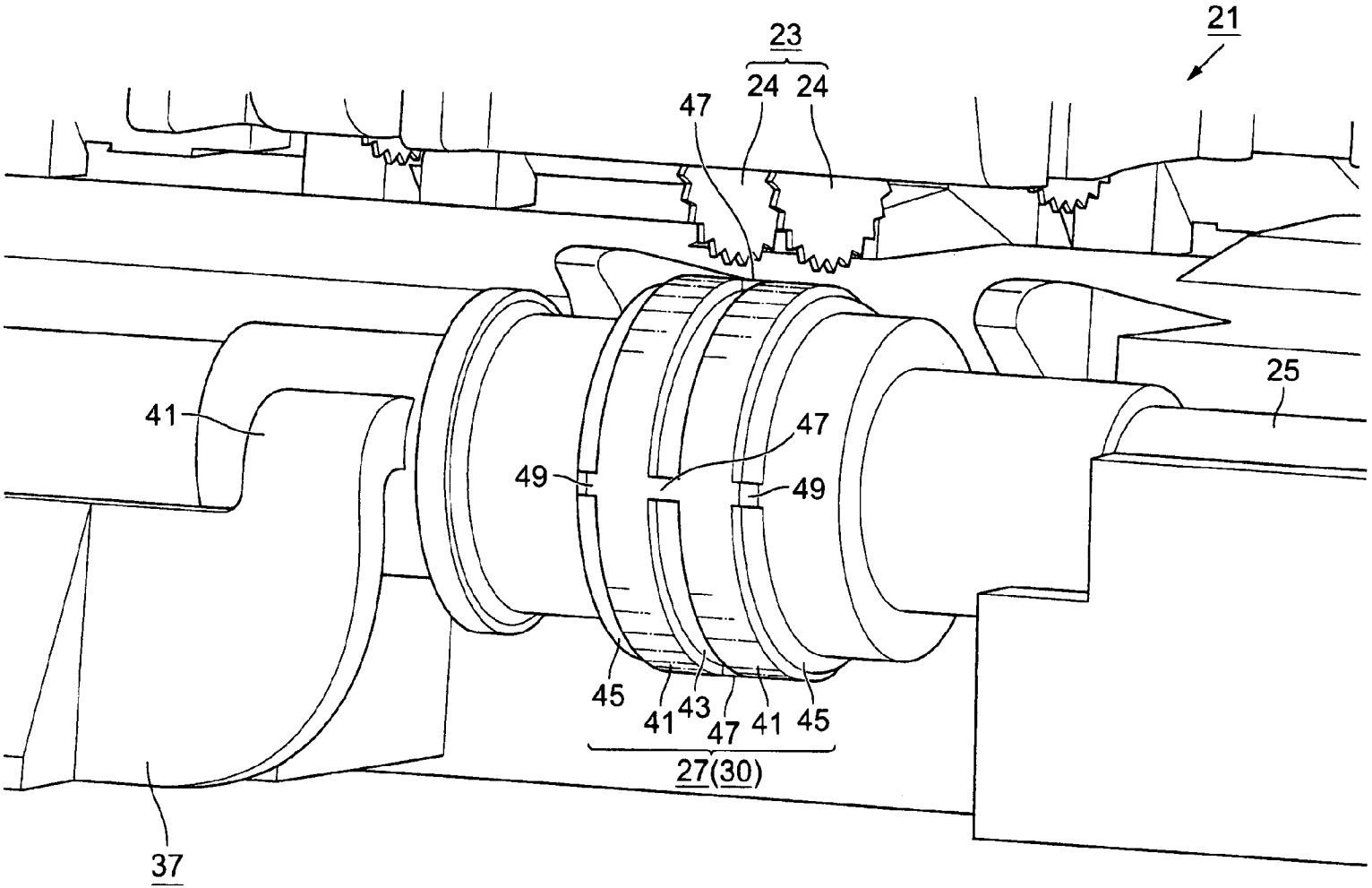
FIG. 4 is a perspective view showing a state of a roller shaft before forming a roller forming portion.

A further specific explanation will be given of a constitution of the roller shaft 25 per se as follows. As shown by FIG. 4, in a state of subjecting the roller shaft 25 to injection molding, the roller carrying portion 27 is formed at a position in correspondence with the respective spur rollers 24. The roller carrying portion 27 is constituted by two roller supporting portions 41 in a projecting shape with cylindrical peripheral faces thereof shape, a groove portion 43 formed between the two roller supporting portions 41, and lower stage portions 45 respectively formed on outer sides of the two roller supporting portions 41. A width of and an interval between the two roller supporting portions 41 are determined such that the two spur rollers 24 are brought into contact with the roller forming portion 29 substantially at centers in the width direction of the respective corresponding roller support portions 41.

Figure 5:
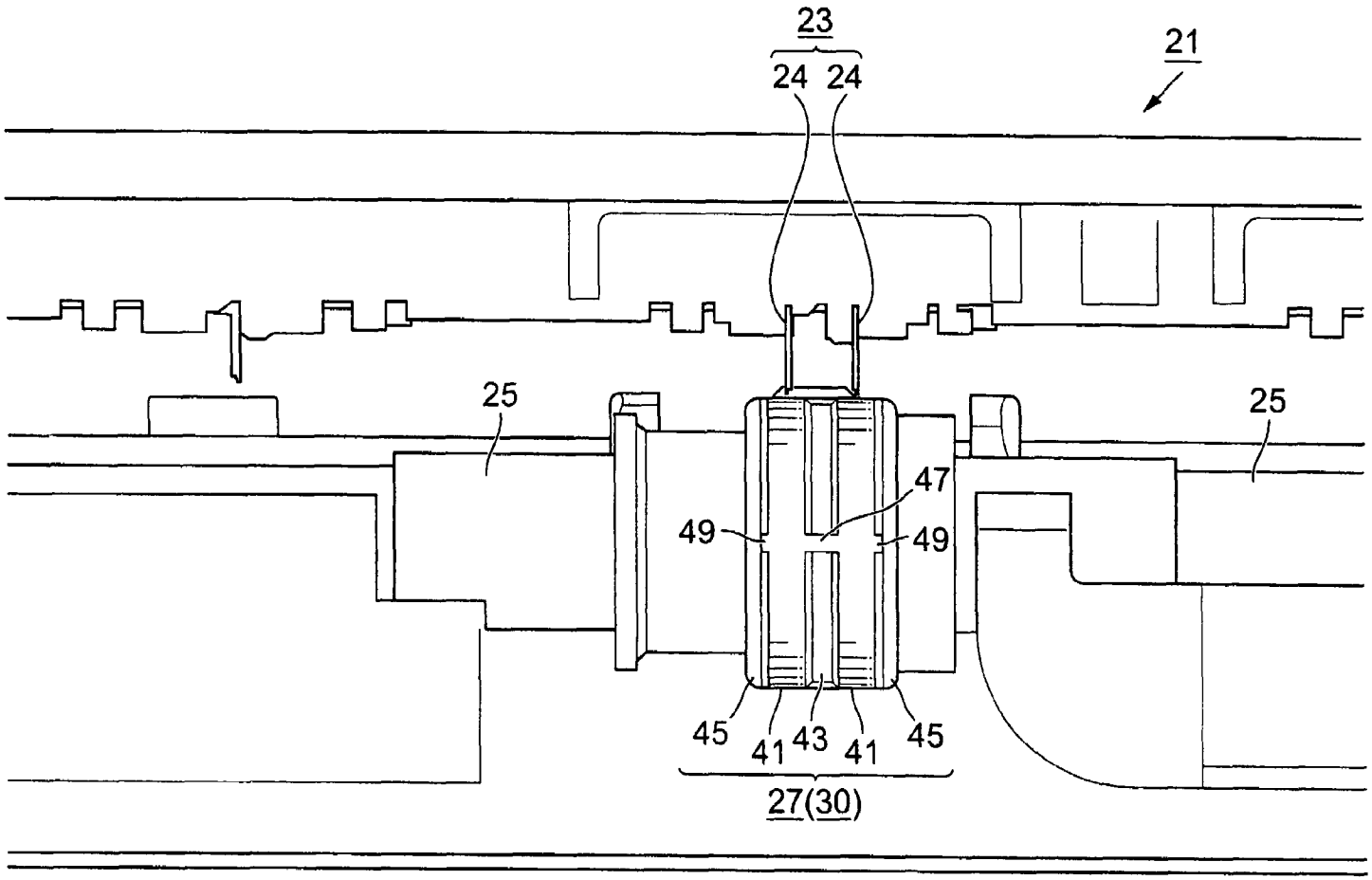
FIG. 5 is a front view showing a state of the roller shaft before forming the roller forming portion.

As shown by FIGS. 4 and 5, the groove portion 43 formed between the two roller supporting portions 41 is formed with four rotation preventing projecting portions 47 at equal intervals in a circumferential direction. A top face of the rotation preventing projecting portion 47 is formed to be flush with circumferential faces of the two roller supporting portions 41. Further, also a portion on an outer side of a position formed with the rotation preventing projecting portion 47 from the roller support portion 41 is formed with a projecting portion 49 so as to expand slightly.

The roller forming portion 29 is formed by injecting elastomer to a surrounding of the roller carrying portion 27 formed with the rotation preventing projecting portion 47 as shown by FIGS. 4 and 5. When elastomer is shrunk by being cooled after injecting elastomer, elastomer injected to surrounding areas of the two roller supporting portions 41 is provided with a uniform thickness and therefore, elastomer is shrunk uniformly. Therefore, a section of a portion of the roller forming portion 29 with which the spur roller 24 is brought into contact becomes a completely round circle. Therefore, the spur roller 24 and the peripheral face of the roller forming portion 29 can realize an always constant contact state and therefore, no abnormality is brought about in operation of discharging the recording medium P.

Further, although elastomer is injected also to the groove portion 43, a thickness of elastomer injected to the groove portion 43 becomes thicker than a thickness of elastomer injected to the surrounding area of the roller support portion 41 and therefore, thicker elastomer at a portion of the groove portion 43 is shrunk more than elastomer in the surrounding area of the roller supporting portion 41 to produce a slightly recessed portion at a step of cooling elastomer. However, the recessed portion formed at a position along the groove portion 43 in this way is not a portion brought into contact with the spur roller 24 and therefore, no abnormality is brought about in the operation of discharging the recording medium P owing thereto.

At a position of the rotation preventing projecting portion 47, elastomer is injected at the groove portion 43 on front and rear sides in a peripheral direction thereof and therefore, elasomter contiguous to the rotation preventing projecting portion 47 is locked by a side face of the rotation preventing projecting portion 47, as a result, in rotating the discharge driving roller 21, the roller forming portion 29 is prevented from being shifted in the peripheral direction in the surrounding area of the roller carrying portion 27.

As other embodiment of the invention, a position of forming the rotation preventing projecting portion 47 may be formed at any position so far as the position is a position at which the spur roller 24 is not brought into contact with the roller forming portion 29 during rotating and a position at which the roller forming portion 29 can be restricted from being rotated in the surrounding area of the roller carrying portion 27. For example, also the projecting portion 49 formed on the outer side of each roller supporting portion 41 can be made to function also as a rotation preventing projecting portion.

Although an explanation has been given of the embodiment of the invention by taking an example of the discharge driving roller 21 of the recording apparatus as mentioned above, the similar constitution is applicable to a roller of other drive system. Further, the invention is applicable similarly not only to the recording apparatus but also to a liquid ejecting apparatus for ejecting a liquid from a liquid ejecting head to a target medium to adhere the liquid to the target medium. In this case, the respective embodiments are applicable similarly to the liquid ejecting apparatus by corresponding a liquid ejecting main body to the recording main body 3 and corresponding the liquid ejecting head to the recording head 13.

What is claimed is:

1. A roller structure comprising:

a first roller member, adapted to be fitted on a roller shaft, and comprising:

at least one first portion, extending in a circumferential direction of the roller shaft, and having a first thickness in a radial direction of the roller shaft; and at least one second portion, extending in the circumferential direction, and having a second thickness in the radial direction which is greater than the first thickness; and at least one projection, formed on the first portion; and a second roller member, formed on the first roller member, and comprising:

a third portion, opposing the second portion, and having a third thickness in the radial direction; and a fourth portion, opposing the first portion, and having a fourth thickness in the radial direction which is greater than the third thickness, wherein, the first roller member comprises a plurality of the first portions and a plurality of the second portions which are alternately arranged in an axial direction of the roller shaft, and wherein, the projection is formed on one of the first portions located between two of the second portions.

2. The roller structure according to claim 1, wherein a plurality of the projections are arrayed in the circumferential direction.

3. The roller structure according to claim 1, wherein a plurality of the projections are arrayed in the axial direction.

4. The roller structure according to claim 1, wherein a top face of the projection is flush with an outer circumferential face of the second portion of the first roller member.

5. The roller structure according to claim 1, wherein a sum of the first thickness and the fourth thickness is identical with a sum of the second thickness and the third thickness.

6. A roller structure comprising:

a first roller member, adapted to be fitted on a roller shaft, and comprising:

at least one first portion, extending in a circumferential direction of the roller shaft, and having a first thickness in a radial direction of the roller shaft; and at least one second portion, extending in the circumferential direction, and having a second thickness in the radial direction which is greater than the first thickness; and at least one projection, formed on the first portion; and a second roller member, formed on the first roller member, and comprising:

a third portion, opposing the second portion, and having a third thickness in the radial direction; and a fourth portion, opposing the first portion, and having a fourth thickness in the radial direction which is greater than the third thickness wherein the second roller member is comprised of elastomer.

7. A roller comprising:

a roller shaft; and the roller structure according to claim 1, fitted on the roller shaft.

8. An apparatus comprising:

a roller shaft; and a roller structure, fitted on the roller shaft, and comprising:

a first roller member, adapted to be fitted on a roller shaft, and comprising:

at least one first portion, extending in a circumferential direction of the roller shaft, and having a first thickness in a radial direction of the roller shaft; and at least one second portion, extending in the circumferential direction, and having a second thickness in the radial direction which is greater than the first thickness; and at least one projection, formed on the first portion; and a second roller member, formed on the first roller member, and comprising:

a third portion, opposing the second portion, and having a third thickness in the radial direction; and a fourth portion, opposing the first portion, and having a fourth thickness in the radial direction which is greater than the third thickness; and a follower roller, opposing the second portion of the first roller member, and adapted to be rotated by the roller.

9. The apparatus according to claim 8, wherein the follower roller is spur roller.

10. The apparatus according to claim 8, wherein the roller is operable to discharge a medium from the apparatus.

* * * * *